US006880297B2

(12) United States Patent
Johnston

(10) Patent No.: US 6,880,297 B2
(45) Date of Patent: Apr. 19, 2005

(54) METHOD AND APPARATUS FOR PROVIDING A MODULAR STORAGE SYSTEM

(76) Inventor: Robert M. Johnston, 209 Gibson St. NW., Leesburg, VA (US) 20176

( * ) Notice: Subject to any disclaimer, the term of this patent is extended or adjusted under 35 U.S.C. 154(b) by 0 days.

(21) Appl. No.: 10/079,833

(22) Filed: Feb. 22, 2002

(65) Prior Publication Data

US 2003/0159378 A1 Aug. 28, 2003

(51) Int. Cl.[7] ..... E04B 1/34

(52) U.S. Cl. ..... 52/71; 52/79.9; 52/238.1; 52/282.5; 52/285.3; 52/584.1; 16/225; 16/351; 16/356; 16/384; 16/DIG. 13; 24/573.11; 24/580.11; 24/581.11; 160/135; 160/202; 160/216; 160/225; 160/231.2; 160/232; 160/351; 160/392; 160/395

(58) Field of Search ..... 52/79.9, 79.12, 52/532.1, 532.2, 584.1, 586.1, 586.2, 585.1, 365, 403.1, 285; 403/331, 387, 4; 160/135, 351, 392, 231.1, 225, 229.1

(56) References Cited

U.S. PATENT DOCUMENTS

| | | | | | |
|---|---|---|---|---|---|
| 1,098,077 | A | * | 5/1914 | R. H. Annison | 405/279 |
| 2,882,564 | A | * | 4/1959 | Couse et al. | |
| 2,978,020 | A | * | 4/1961 | Paulsrude | 160/183 |
| 3,234,996 | A | * | 2/1966 | King et al. | 160/199 |
| 3,310,917 | A | * | 3/1967 | Simon | 52/91.1 |
| 3,324,930 | A | * | 6/1967 | Colombo | 160/231.2 |
| 3,326,268 | A | * | 6/1967 | Dixon | 160/231.2 |
| 3,363,383 | A | * | 1/1968 | La Barge | 52/471 |
| 3,403,720 | A | * | 10/1968 | Ahleen | 160/231.2 |
| 3,441,975 | A | * | 5/1969 | Shepherd | 16/225 |
| 3,460,282 | A | * | 8/1969 | Swirsky | 40/530 |
| 3,640,039 | A | * | 2/1972 | McKee et al. | 52/281 |
| 4,052,267 | A | | 10/1977 | McFee | |
| 4,128,983 | A | * | 12/1978 | Matsubara | 52/731 |
| 4,131,971 | A | * | 1/1979 | Saarloos | 16/225 |
| 4,218,047 | A | * | 8/1980 | Douglas | 256/1 |
| 4,269,663 | A | | 5/1981 | McFee | |
| 4,312,709 | A | | 1/1982 | Stark et al. | |
| 4,342,623 | A | | 8/1982 | Loeffler | |
| 4,344,475 | A | * | 8/1982 | Frey | 160/135 |
| 4,438,605 | A | * | 3/1984 | DeLucia | 52/71 |
| 4,461,131 | A | * | 7/1984 | Pressell | 52/395 |
| 4,584,061 | A | | 4/1986 | Shelton | |
| 4,777,777 | A | * | 10/1988 | Massimo | 52/586 |
| 4,818,344 | A | | 4/1989 | Glucksman | |
| 4,823,531 | A | * | 4/1989 | Labelle | 52/586 |
| 4,828,132 | A | * | 5/1989 | Francis et al. | 220/6 |
| 4,830,080 | A | * | 5/1989 | Densen | 160/135 |
| 4,935,995 | A | * | 6/1990 | Daus, Jr. | 24/580.1 |
| 4,968,171 | A | * | 11/1990 | Shell | 403/4 |
| 5,088,434 | A | * | 2/1992 | Harding | 114/85 |
| 5,133,108 | A | * | 7/1992 | Esnault | 16/225 |
| 5,148,850 | A | * | 9/1992 | Urbanick | 160/231.1 |
| 5,450,694 | A | * | 9/1995 | Goranson et al. | 52/71 |
| 5,502,930 | A | * | 4/1996 | Burkette et al. | 52/71 |
| 5,609,732 | A | | 3/1997 | Magidson | |
| 5,613,541 | A | * | 3/1997 | Bradbury | 160/231.2 |
| 5,628,879 | A | | 5/1997 | Woodruff | |
| 5,803,146 | A | * | 9/1998 | Boon | 160/135 |
| 5,951,825 | A | | 9/1999 | Land | |
| 6,453,632 | B1 | * | 9/2002 | Huang | 52/403.1 |
| 6,510,589 | B1 | * | 1/2003 | Scharge | 16/366 |

* cited by examiner

*Primary Examiner*—Carl D. Friedman
*Assistant Examiner*—Yvonne M. Horton
(74) *Attorney, Agent, or Firm*—James E. Goepel; Richard E. Kurtiz; Greenberg Traurig, LLP

(57) ABSTRACT

A modular system for assembling a storage unit is provided which includes a plurality of panels and different connectors. The system allows for subdividing spaces which may feature walls, floors, ceilings, etc. at varying angles or in areas having irregular contours. Additionally, the connectors are simple recesses and protrusions which allow for easy assembly and disassembly of the storage unit.

12 Claims, 7 Drawing Sheets

METHOD AND APPARATUS FOR PROVIDING A MODULAR STORAGE SYSTEM

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

FIELD OF THE INVENTION

The present invention relates in general to storage units, and in particular to a modular storage system having a series of panels connected at varying angles for subdividing irregular storage spaces.

BACKGROUND OF THE INVENTION

Modular systems for building storage units and shelves come in a variety of shapes and sizes. These systems are often built or assembled with a series of panels forming the sides, top and bottom, the panels being attached using connectors. Typically, these panels and connectors are designed specifically to enable connection between adjacent panels at right angles which form the walls of the storage units. While these systems are well designed for conventional spaces, they often fail to efficiently use space where walls may be non-parallel or have irregular contours. Moreover, these conventional units are limited to certain established configurations which may not suit an area's particular needs. Thus conventional storage units often do not adequately make use of all of the space available to them.

Another drawback of conventional storage units is that the connectors are often rigid and typically have complex structure. These complex connectors may be difficult to assemble and also do not allow for flexible connections between panels or for easy assembly and disassembly of the storage units. Conventional connectors also often require attachment through the supporting walls which can affect the storage unit's structural integrity. Moreover, these complex connectors can also result in increased manufacturing cost of the storage system.

Thus it would be desirable to provide a modular wall system which will allow for connections of panels at varying angles to maximize storage efficiency. Additionally, it would be desirable to provide a system which allows for flexible connections which are easily assembled and disassembled. Ideally, with this improved storage system, panels may be connected with a variety of different connectors and assembled in many different configurations for use in more than one area.

OBJECTS AND SUMMARY OF THE INVENTION

In accordance with the general object of the present invention, a modular system for assembling a storage unit is provided which allows for positioning of storage units which fit in spaces which may have irregular contours or in corners which may not form a right angle.

It is another object of the present invention to provide a modular wall system which has flexible, easy to use connectors.

It is still a further object of the present invention to provide a modular storage system which can be connected with a variety of different types of connectors.

The modular storage system of the present invention includes a plurality of panels each of which has a top surface, a bottom surface and side edges. The top surfaces of the panels have a plurality of panel recesses. The system further includes connectors which include two elongated end portions each having a recess along the length thereof and joined together by a flexible linkage. Preferably, each of the panels includes at least one side recess along one of the side edges. Advantageously, the panel recesses extend parallel to one another between two opposite side edges. In a preferred embodiment, each panel has a first set of panel recesses which run parallel to each other and a second set of panel recesses which extend parallel to one another and at an angle, preferably 90 degrees, with respect to the first set of recesses. The system also includes connecting links which connect the panels to the connectors. These connecting links have a first end which is received in the panel recesses and a second end which is received in the connector recesses. Preferably, the ends of the connecting links are joined by a shaft which allows rotation and flexion of the connector relative to the panel. The shaft may, for example, include a ball and socket joint.

In accordance with another aspect of the present invention, a modular system for assembling a storage unit is provided. The unit includes a plurality of panels each having a top surface, a bottom surface and side edges. The top surfaces include a plurality of panel recesses. The plurality of panels are joined to each other by connecting links. The links have a first end receivable in the recesses of a first panel, a second end receivable in the recesses of a second panel and a flexible shaft connecting the two ends. In an advantageous embodiment, the flexible shaft may be in the form of a ball and socket joint.

In accordance with still another aspect of the present invention, a modular system for building a storage unit is provided. The unit includes a plurality of panels, each of the panels having a top surface, a bottom surface and side edges. The panels include a plurality of parallel spaced cylindrical shaped recesses which open in the top surface and in the side edges. Additionally, the unit includes connectors for connecting the panels. The connectors include at least two parallel elongated portions connected by a flexible linkage along their lengths, each of the portions having a cylindrical-shaped recess therein extending along its length. The unit also includes connecting links for connecting the panels to the connectors. The connecting links include first and second cylindrical shaped portions connected by a flexible shaft. The first portion o: the connecting link is receivable in one of the panel recesses and the second portion is receivable in one of the connector recesses.

Further features and advantages of the present invention will be set forth in or apparent from, the detailed description of preferred embodiments thereof which follows.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

DETAILED DESCRIPTION OF THE PREFERRED EMBODIMENT

Reference will now be made in detail to the preferred embodiments of the present invention, examples of which are illustrated in the accompanying drawings.

Figure 1:
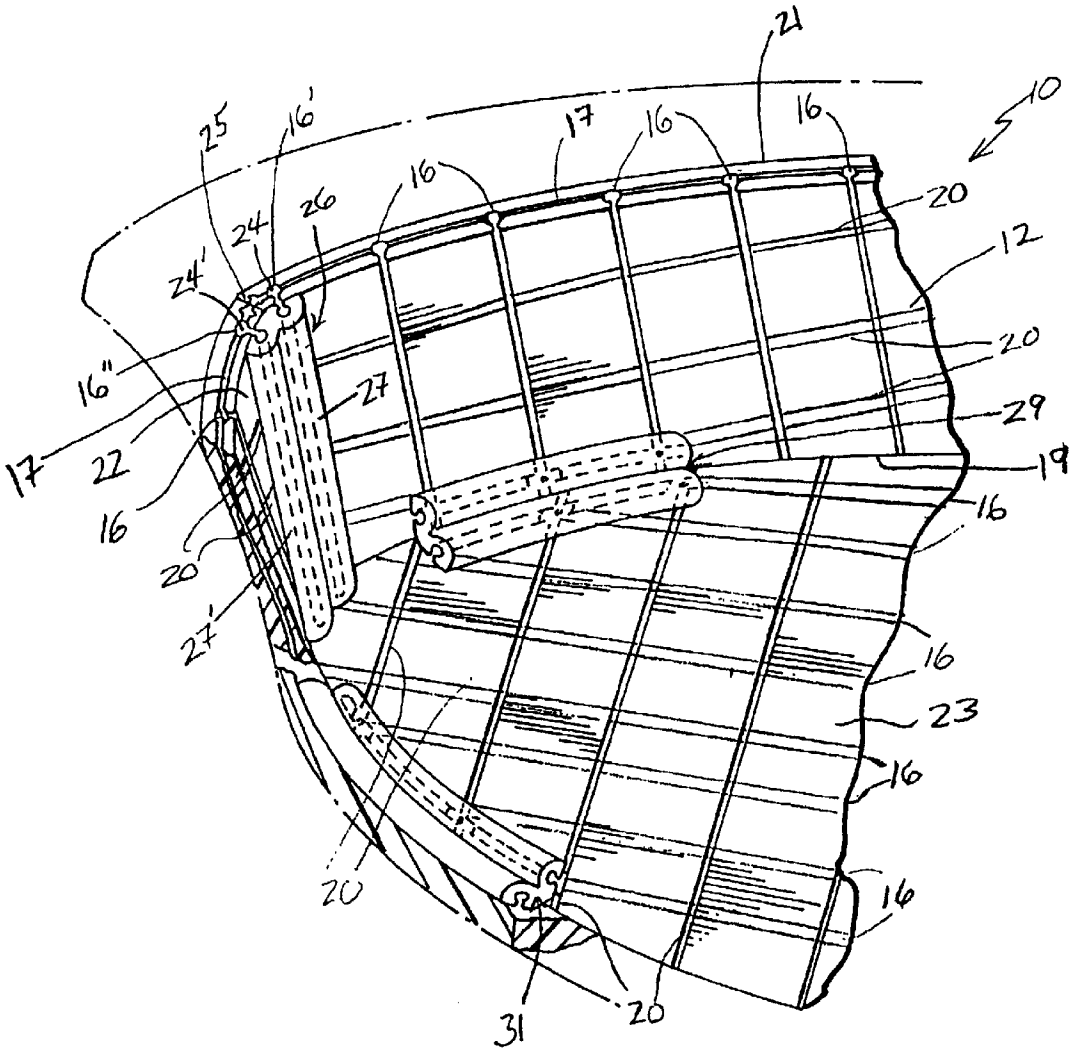
FIG. 1 is a front perspective view illustrating a modular storage unit constructed in accordance with the invention in use in a location having non-perpendicular walls.

FIG. 1 shows the modular system of the invention assembled as a storage unit 10 in the interior of a structure, such as a sailboat, wherein the walls are curved and are not at 90 degrees with respect to one another. The storage unit 10 includes a first panel 12 which includes a series of recesses 16. A second panel 22 is joined to the first panel 12 by two connecting links 24, 24' and a connector 26. Specifically, the first panel 12 is joined to connecting link 24 at recess 16' and is joined to one elongated portion 27 of connector 26. The connector 26 is joined to the second panel 22 via connecting link 24' at recess 16' and joined to the second elongated portion 27' of connector 26. The advantage of using two connecting links 24, 24' and a connector 26 to join adjacent panels 12, 22 is that it allows the storage unit 10 to be assembled in a variety of configurations including those in which the panels are connected at non-right angles as shown in FIG. 1. For purposes of clarity in illustrating the invention, only two connecting links 24, 24' are shown in FIG. 1. However, it will be understood that in a typical application more than two connecting links will be required to secure the panels 12 and 22. A third panel 23 forms the base of the storage unit and is connected to panels 12, 22 via connectors 29, 31, respectively. A number of different connections and units may be formed using the panels, connectors and connecting links. The connecting links 24, 24' may have one or more edges which have ridges or other means for providing friction to prevent slippage of the panels once they are assembled together. If one surface of the links are provided with ridges and other surfaces are not, the panels may thereby be made to slide together in one direction easily during assembly of the panels, but not to slide in a reverse direction so as to prevent slippage of the assembled panels.

Figure 1A:
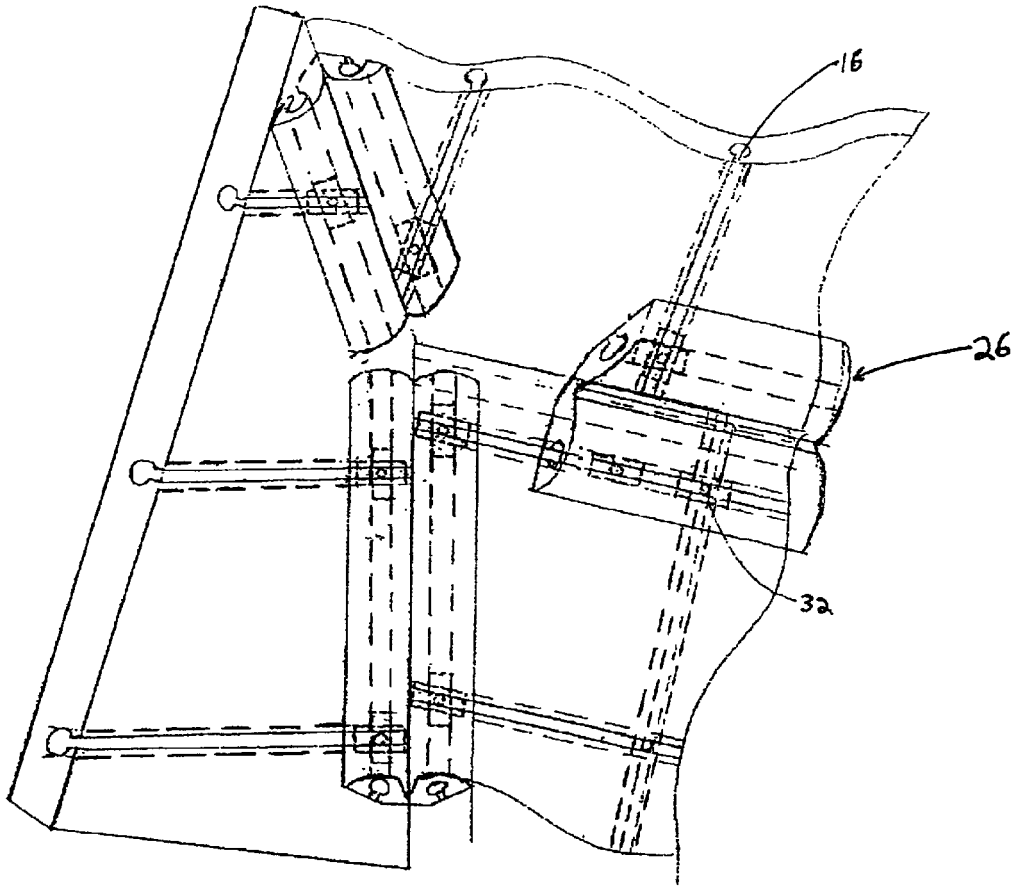
FIG. 1A is a perspective view showing the detail of the interconnection of the panel members by stop links.

FIG. 1A is a perspective view showing the detail of the interconnection of the panel members by connectors 26 and connecting links 32. In the embodiment shown, stop links are used as connecting links 32. Such stop links may be used, e.g., where sliding of the panels is not desired. While FIG. 1A shows stop links connecting the panels only at portions of the panels where the recesses cross, it will be understood by those skilled in the art that connecting links may be used at any point along the recesses without departing from the spirit and scope of the invention.

The panels may be of any shape or size, and may be constructed from any suitable material. Standard shapes and sizes may be provided and may be cut and combined to provide a storage system that fits any particular irregularly-shaped space. Typically, the panels are rectangular such as panels 12, 22, but may be triangular or have one or more curved edges. The panels may be constructed from any material which is pliable enough to fit into a space between walls which are not positioned at 90 degrees with respect to each other, but rigid enough to hold the objects for which the storage unit is being used.

Figure 2A:
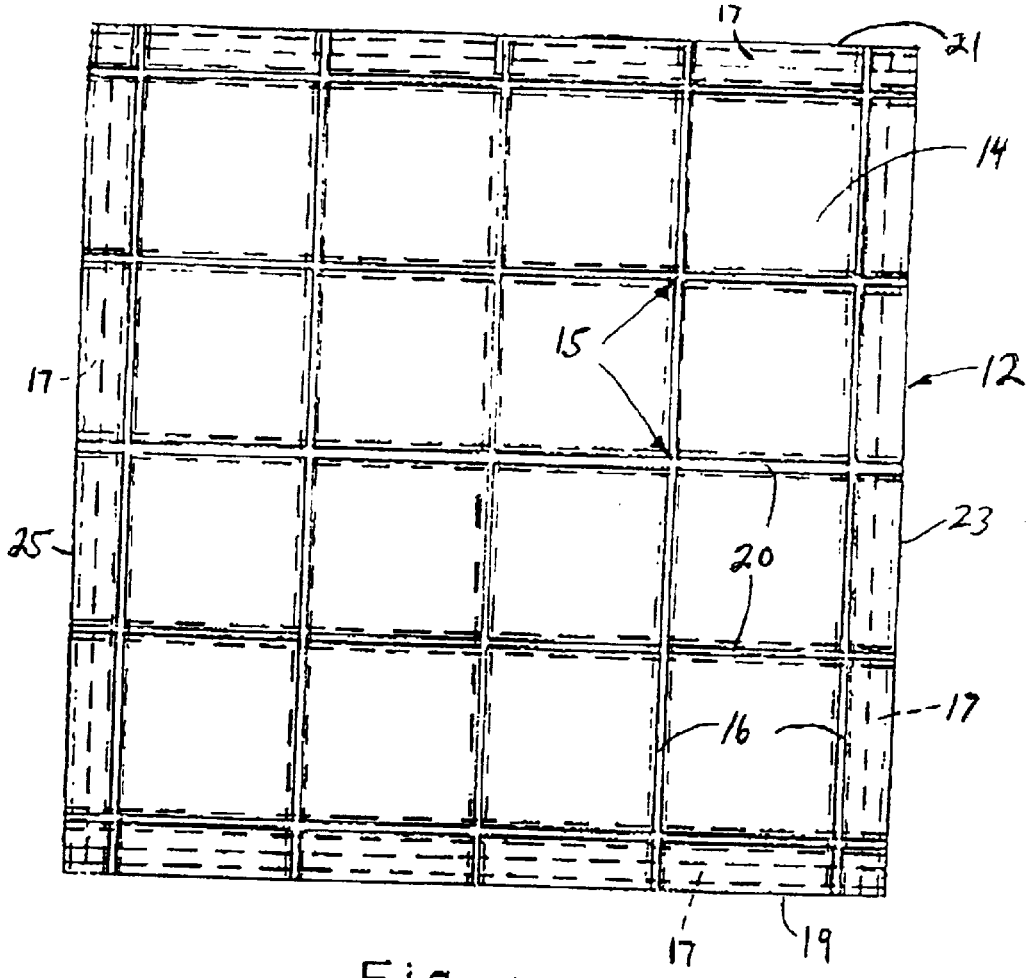
FIG. 2A is a top view of a panel member.
Figure 2B:
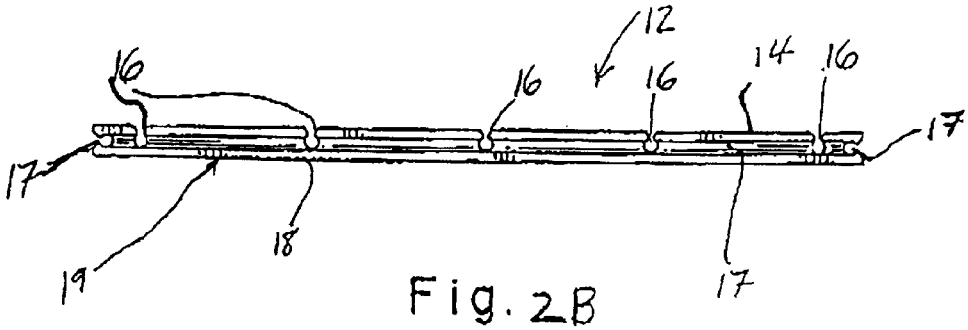
FIG. 2B is a side view of the panel member in FIG. 2A.

Turning now to FIGS. 2A–B, the structure of the panels is described in greater detail with reference to panel 12. Panel 12 includes a top surface 14 and a bottom surface 18. The panel 12 includes a first set of recesses 16. A second set of recesses 20, on the opposite side of panel 12 from recesses 16, intersect and are positioned at an angle with respect to the first set of recesses 16. The recesses 16, 20 may be positioned at various intervals along the top surface 14 and/or bottom surface 18. Preferably, however, the first set of recesses 16 run parallel to one another and extend from one edge 19 to an opposite edge 21 and the second set of recesses 20 run parallel to each other from another panel edge 23 to an opposite edge 25 such that they are at an angle of 90 degrees with respect to the first set of recesses 16. This configuration of the recesses 16, 20 allows for multiple choices in deciding how to connect adjoining panels. Additionally, the configuration of the recesses 16, 20 allows for connection of multiple panels at varying angles. Preferably, panel 12 includes at least one recess 17 in one or more of the side edges 19, 21, 23, 25. The recesses 16, 17, 20 may have any shape suitable for receiving the connecting links, although they are typically cylindrical with an opening for receiving the connecting links as discussed in connection with FIGS. 3A–C below.

Figure 3A:
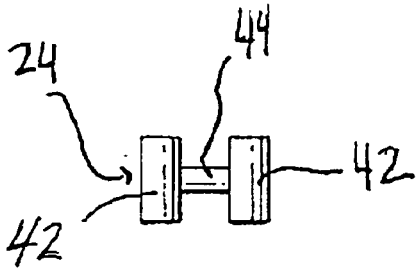
FIG. 3A is a side view of a connecting link.
Figure 3B:
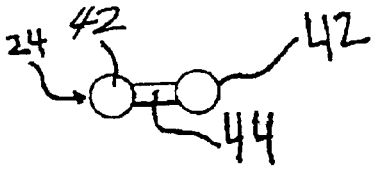
FIG. 3B is a top view of the connecting link in FIG. 3A.
Figure 3C:
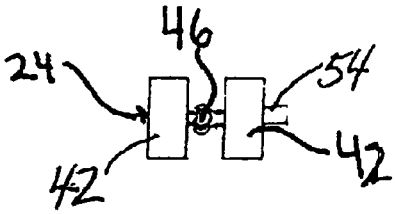
FIG. 3C is a side view of a stop link which further includes a ball and socket joint.

FIGS. 3A–C show a connecting link 24 which allows for connection of adjacent panels. Each connecting link 24 includes two end portions 42. The end portions 42 are preferably of a shape which corresponds to the shape of the recesses and are sized to fit snugly within the recesses. In the embodiment shown in FIGS. 3A–B, the end portions 42 are connected by a shaft 44 which is preferably flexible to allow for connection of adjacent panels at varying angles. Alternatively, as shown in FIG. 3C, end portions 42 may be connected by a ball and socket joint 46 providing for rotation and flexion. Connecting links 24 may further include a protrusion 54, also shown in FIG. 3C, extending outwardly from one or both end portions 42. The protrusion 54 is designed to fit within the recesses at points 15 where the recesses intersect to prevent slippage in any direction within the recesses 16, 20. Recesses 16 and 20 are preferably of equal dimension and positioned within the mid portion of panel 12 such that, at their point of intersection, a through aperture is created. A protrusion 54 is positioned within the recesses to prevent slippage. This allows for the assembly of heavier load bearing storage units.

The connectors 26, 60 shown in FIGS. 4A–F include two elongated end portions 29, 39, 61 connected by a hinge 34, 40, 64 along the lengths thereof to allow flexion. In the embodiments, shown in FIGS. 4A–D, the connectors 26 include recesses 28, 38 and are of a shape suitable for allowing end portions 42 of the connecting links 24 to snap firmly into them, thus providing a tight bond between panels. If the connectors are fabricated of a flexible material, a single connector type may be used and may be flexed to form either the connector shown at 26 or the connector shown at 26. In an alternative embodiment, shown in FIGS.

Figures 4A, 4C:
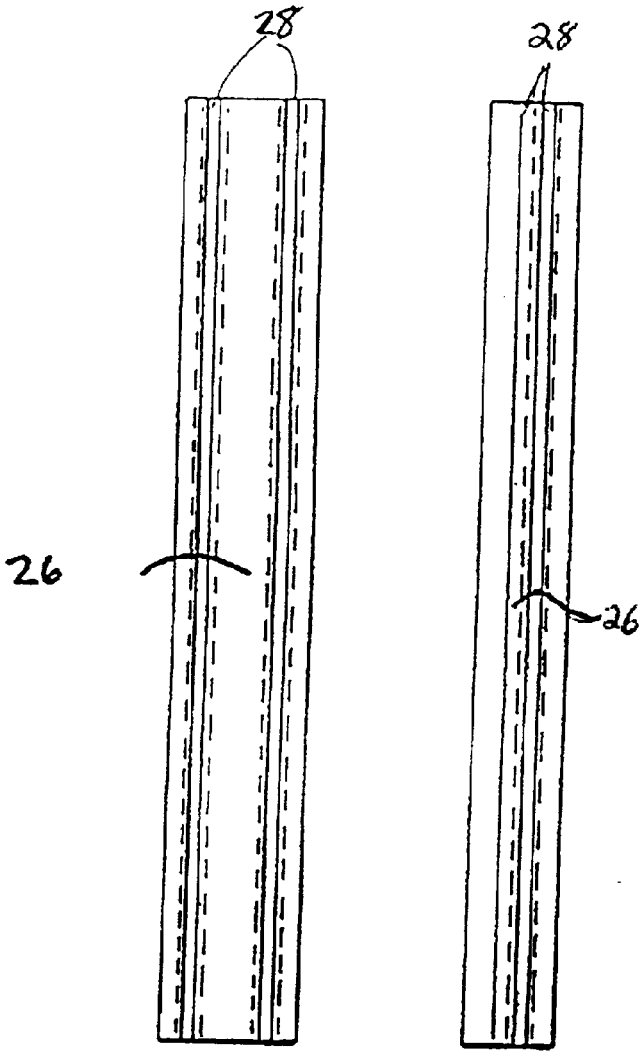
FIG. 4A is a planar view of a flat connector.
FIG. 4C is a planar view of an angled connector.
Figures 4B, 4D:
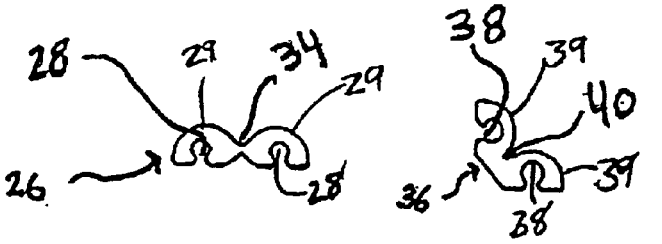
FIG. 4B is an edge view of the connector in FIG. 4A.
FIG. 4D is an edge view of the connector in FIG. 4C.
Figure 4E:
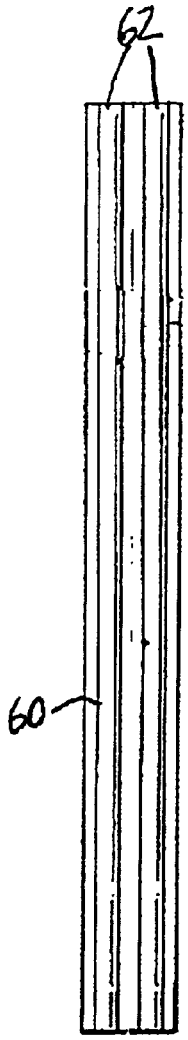
FIG. 4E is a planar view of a connector for direct connection of panels at right angles.

4E–F, wherein adjacent panels are connected at right angles or any angle that the connectors can flex to, connectors 60 may be formed with protrusions 62 which snap directly into parallel, appropriately spaced panel recesses, thereby eliminating the need for connecting links 24 and increasing the rigidity of the connection between panels. While FIGS. 4*a* and 4*b* show an embodiment wherein adjacent panels are connected in a planar configuration, and FIGS. 4*c* and 4*d* show an embodiment wherein adjacent panels are connected at right angles to one another, it will be understood that adjacent panels may be connected at various angles without departing from the spirit and scope of the invention.

The hinge 34, 40, 64 can be constructed to allow for varying degrees of flexion. In the FIGS. 4A–B and 4E–F embodiments, hinges 34, 64 are constructed so that adjacent panels may be rotated such that they assume an angle with respect to one another ranging from 60 to 240. FIGS. 4C–D illustrates connector 26 in the 90-degree orientation. This allows for connection of adjacent panels at a number of different angles.

Figure 5A:
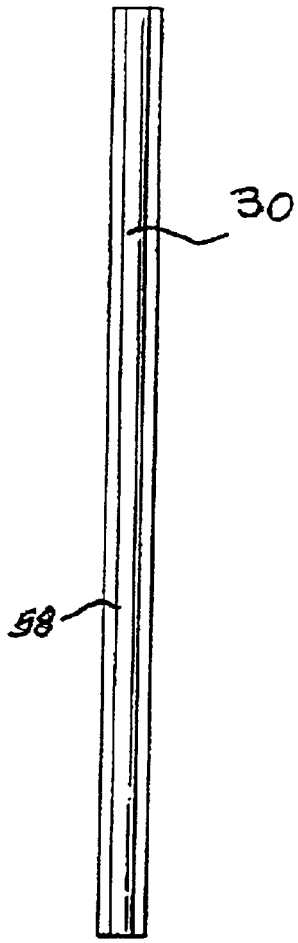
FIG. 5A is a planar view of a top link.
Figure 4F:
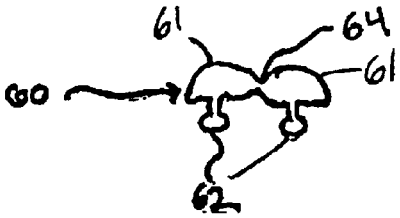
FIG. 4F is an edge view of the connector in FIG. 4E.
Figure 5B:
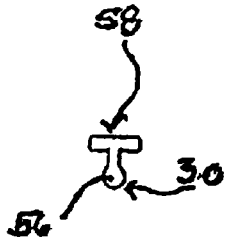
FIG. 5B is an edge view of the top link in FIG. 5A.

The storage unit 10 preferably further includes top links 30. The top links 30 finish the exposed edges and also provide rigidity to the unit 10. Top links 30, shown in FIGS. 5A–B may be included to finish the panels by closing the recesses, most typically the side edge recesses 17. Top links 30 also provide added rigidity to the storage unit. The top links 30 are designed to snap into the recesses. The top links 30 include one connection portion 56 and one finished side 58. Thus, the top link 30 is connected by snapping the connection portion 56 firmly into a recess, thus providing added rigidity. The finished side 58 then provides a smooth edge to the finished unit 10 and may also be decorative.

While the invention has been particularly shown and described with reference to a preferred embodiment thereof, it will be understood by those skilled in the art that various changes in form and details may be made therein without departing from the spirit and scope of the invention.

The embodiments of the invention in which an exclusive property or privilege is claimed are defined as follows:

1. A modular system for assembling a storage unit comprising:

a plurality of panels each having a top surface, a bottom surface and side edges, said top surface having a plurality of panel recesses;

connectors comprising at least two end portions each having a connector recess therein and joined by a flexible linkage; and links for connecting said panels to said connectors, said links having a first end receivable in said panel recesses and a second end receivable in said connector recesses.

2. The modular system according to claim 1 wherein said panels include at least one recess along at least one of said edges.

3. The modular system according to claim 1 wherein said plurality of panel recesses includes a first set of recesses extending parallel to one another between two opposite side edges.

4. The modular system according to claim 3 wherein said plurality of panel recesses includes a second set of recesses extending parallel to one another and perpendicular to said first plurality of panel recesses.

5. The modular system according to claim 1 wherein said panel recesses and said connector recesses are cylindrical in shape.

6. The modular system according to claim 5 wherein said first and second ends of said links are cylindrical in shape.

7. The modular system according to claim 1 wherein said first and second ends of said links are joined by a shaft which allows said connectors to rotate and flex relative to said panels.

8. The modular system according to claim 7 wherein said shaft includes a ball and socket.

9. The modular system according to claim 1 wherein said links further comprise a protrusion extending outwardly from at least one of said first and second ends to prevent movement when at least one of said first and second ends is positioned at the point of intersection of said recesses.

10. A modular system for building a storage unit comprising:

a plurality of panels, each of said panels having a top surface, a bottom surface and side edges, said panels including a plurality of parallel spaced cylindrically shaped recess openings in said top surface, said bottom surface, and in said side edges;

connectors for connecting said panels, said connectors comprising at least two parallel elongated portions connected by a flexible linkage along their lengths, each of said portions having a cylindrically shaped recess therein extending along its length; and connecting links for connecting said panels to said connectors, said connecting links comprising first and second cylindrically shaped portions connected at a point along their respective lengths by a flexible shaft, said first portion being receivable in one of said panel recesses and said second portion being receivable in said connector recesses.

11. The modular system according to claim 10 wherein said flexible shaft allows positioning of adjacent panels at an angle ranging from 60 to 180 degrees.

12. A modular system for building a storage unit, wherein intersecting walls of the storage unit are connectable regardless of the angle of intersection, comprising:

a plurality of panels, each of said panels having a top surface, a bottom surface, and side edges;

a plurality of connectors and flexible linkages for linking said panels to said connectors, each of said flexible linkages having at least two end portions joined by a flexible shaft;

wherein said connectors are comprised of at least two flexibly joined pieces, each of said flexibly joined pieces further comprising at least one attachment means, wherein said attachment means includes one of a recess and a protrusion;

wherein a first end portion of said flexible linkages includes one of said recess and said protrusion, for attaching to said connectors, said protusions being receivable in said recesses; and wherein at least one surface of said panels includes one of said recess or said protrusion and a second end portion of said flexible linkages includes the other of said recess or said protrusion, for mating with said panels.

* * * * *